United States Patent [19]

Gasparrini

[11] 4,300,450

[45] Nov. 17, 1981

[54] PRINTING PRESS LIQUID CIRCULATING SYSTEM INCLUDING AN ANTI-FOAMING DEVICE

[75] Inventor: Charles R. Gasparrini, Rye, N.Y.

[73] Assignee: Baldwin-Gegenheimer Corporation, Stamford, Conn.

[21] Appl. No.: 40,438

[22] Filed: May 18, 1979

[51] Int. Cl.[3] ..... B41F 31/02; B41L 27/04

[52] U.S. Cl. ..... 101/364; 101/366

[58] Field of Search ..... 101/364, 350, 148, 363, 101/366, 344, 347, 355, 356, 360, 207, 208, 210; 417/174, 176, 79, 77, 76, 182.5, 182, 178, 87, 88, 190, 191, 187, 188; 137/563, 533, 533.17

[56] References Cited

U.S. PATENT DOCUMENTS 1,640,408 8/1927 House ..... 137/533.17 X 2,755,816 7/1956 Collins ..... 137/533.17 X 3,352,317 11/1967 Dahlgren ..... 101/350 X 3,490,376 1/1970 Valdespino ..... 417/190 X

*Primary Examiner*—J. Reed Fisher

*Attorney, Agent, or Firm*—St. Onge, Steward, Johnston, Reens & Noe

[57] ABSTRACT

A printing press liquid circulation system including an anti-foaming device, the system being of the type wherein flow of liquid from a fountain pan to a reservoir is induced or suctioned through a return conduit by connecting the return conduit to a suction inlet of an aspirator. In order to reduce or eliminate the tendency of the aspirator to draw or suction air through the return conduit and, thus reduce or eliminate foaming in the system, the suction pressure in the return conduit is controlled to eliminate the suctioning of air through the return conduit.

8 Claims, 5 Drawing Figures

PRINTING PRESS LIQUID CIRCULATING SYSTEM INCLUDING AN ANTI-FOAMING DEVICE

BACKGROUND OF THE INVENTION

1. Field of the Invention

The present invention relates to printing presses. More particularly, the present invention relates to a printing press of the type including a liquid circulation system for providing constant flow of filtered liquid to a fountain pan on the press.

2. Description of the Prior Art

In a conventional printing press liquid circulating system, a cylindrical roller is partially immersed in the fountain pan and is rotated to pick up liquid from the pan and distribute a uniform film of liquid to a mating roller. Circulating the liquid in the fountain pan is desirable for several reasons. Circulation of the liquid maintains a minimum liquid temperature gradient across the pan. If the temperature gradient of the liquid across the pan is excessive the quality of the printing is adversely affected. Moreover, the circulation of the liquid prevents growth of algae. By circulating the liquid, foreign particles may be flushed from the pan and filtered from the liquid. In addition to providing a constant flow of water through the pan, a constant level of fluid in the pan is necessary to establish constant and desirable liquid feed rates to the rollers of the dampening system. Liquid which is being pumped into the pan, rises to the height of the standpipe and then drains through the standpipe to a return conduit.

The standpipe in the pan is connected via the liquid return conduit to a liquid reservoir wherein the liquid is stored before being recirculated to the fountain pan. In order to filter the liquid, that is, removed undesirable particles and other matter from the liquid, the liquid in the return conduit is passed through a filter prior to entering the reservoir. One particularly prevalent type of filter used in liquid circulating systems for printing presses is a cannister type filter, that is, a type of filter having a cylindrical perforated housing wrapped with a water permeable filter. The fluid is delivered into the interior of the cylinder and forced radially outwardly through the perforations in the housing. In order to provide the required pressure to force the liquid through the filter, an aspirator is connected in the return line upstream of the filter. The aspirator includes a motive flow passage through which liquid is pumped from the reservoir and back into the reservoir via the filter. The aspirator further includes an inlet port to which the return line from the fountain pan is connected. As liquid is pumped through the motive flow passage, liquid is drawn or suctioned from the return conduit and forced through the filter. Typically, the pump which provides for flow of liquid through the motive passage of the aspirator also provides for pumping of the liquid via a supply conduit back into the fountain pan on the press.

Although the above described circulation systems have functioned adequately for many years, one problem has been encountered during the use of the systems and is known in the printing art as "foaming." When the liquid is drawn from the fountain pan with the use of an aspirator, a negative pressure, that is, a pressure below atmospheric pressure, is induced in the return conduit. The negative pressure not only results in suctioning of the liquid through the return line, but also, results in the suctioning of air into the return line and through the remainder of the system. Thus, the air is suctioned into the aspirator and is mixed with the liquid being circulated through the aspirator. The introduction of air into the liquid causes foaming in the reservoir. In severe cases, foaming of the liquid in the reservoir may cause the reservoir to overflow. Moreover, the foam can be pumped by the circulating pump from the reservoir into the fountain pan. The presence of foam in the fountain pan has a noticeably adverse effect on the quality of printing. Foam in the water fountain pan of an offset printing press creates non uniform dampening on the dampening roller. This creates improper dampening of the non image area of the plate which in turn causes ink to plug into the non image area of the plate and hence the printed signature. Foam in the ink fountain of a flexagraphic press causes uneven ink distribution to the anilox fountain roller nip which results in uneven ink density on the printed signature.

SUMMARY OF INVENTION

The undesirable foaming is eliminated by preventing air from being suctioned into the system through the standpipe by the aspirator. The suctioning of air is prevented by controlling the suction pressure in the return pipe between the aspirator and the standpipe.

In one embodiment of the invention the suction pressure in the return pipe is reduced by including a second connection to the aspirator suction inlet via a conduit to the reservoir. When flow of liquid is forced through the motive passageway of the aspirator by the pump, liquid is drawn from the reservoir through the conduit to the suction inlet of the aspirator and returned to the reservoir via the filter. By providing a second source of liquid for the aspirator, the negative pressure in the return conduit which is also connected to the suction inlet of the aspirator is reduced.

It should be understood that there are basically two types of printing press liquid circulating systems in which an aspirator is used to force the liquid from the pan through a filter. In one system, the height of the fountain pan is lower than the height of the aspirator and thus, in order to drain the pan, the liquid must be suctioned against gravity by the aspirator. Once the liquid in the return line is mixed with the fluid being supplied through the motive flow passage, the mixture of the liquids is forced downwardly through the filter. In this first type of circulating system, it is typical for the fountain pan to be located approximately one foot from the floor and for the aspirator to be located between about two feet and three feet from the floor. Thus, the liquid from the fountain pan must be suctioned against gravity, a distance between about one and two feet. In this type of circulating system, the return conduit from the fountain pan typically extends downwardly to floor level eight to twelve inches from the standpipe and then is directed upwardly to the aspirator. In a conventional circulating system, the negative pressure induced in the return conduit is sufficient to draw air through the standpipe and into the aspirator. In order to eliminate the suctioning of air, the aspirator is provided with a second connection via a conduit to the reservoir and a poppet valve is positioned in the conduit.

The poppet valve allows for flow of liquid therethrough when the negative pressure in the line between the poppet and the aspirator reaches a predetermined amount. As the negative pressure in the return conduit approaches, but does not reach, a point where air will be suctioned through the standpipe, the poppet valve allows for liquid to flow from the reservoir into the suction port of the aspirator and the negative pressure in the return line is reduced. Thus, the poppet valve allows the negative pressure in the return line between the aspirator and the pan to reach a pressure sufficient to suction only liquid and not air, through the return pipe.

The negative pressure maintained in the return pipe is insufficient to suction all of the liquid in the return conduit immediately beneath the standpipe. Thus, an artificial liquid level is created in the conduit beneath the pan and liquid may drain through the standpipe to the liquid level in the return conduit.

In a second type of circulating system, the height of the aspirator is below the height of the pan. The aspirator is necessary to mix the unfiltered liquid with filtered liquid and force the mixture through the filter. However, the aspirator may induce an undesirably high suction pressure in the return conduit and draw air into the aspirator. In order to control the negative pressure in the liquid return conduit, the aspirator includes a second connection via a conduit to the reservoir. Since it is desirable for the pressure in the return conduit at the aspirator to be maintained at approximately atmospheric pressure, there is no requirement for a poppet valve to be inserted in the conduit between the aspirator and the reservoir. Thus, by connecting the suction port of the aspirator to the reservoir, the pressure at the aspirator suction port is essentially atmospheric and the pan flow can drain to this point by virtue of the difference in elevation between the aspirator and pan.

In another embodiment of the invention, the suction pressure in the return conduit between the aspirator and the standpipe is controlled by a throttle valve which is positioned upstream of the aspirator. The throttel valve controls the liquid flow rate through the aspirator, which, in turn, controls the suction pressure in the return conduit. In still another embodiment of the invention, the suction pressure in the return conduit between the aspirator and the standpipe is controlled by a vacuum pressure regulator which is positioned in the return conduit between the aspirator and the fountain pan. This vacuum pressure regulator controls the suction pressure in the return conduit to a pressure value where the suctioning of air is eliminated.

DETAILED DESCRIPTION OF THE INVENTION

Figure 1:
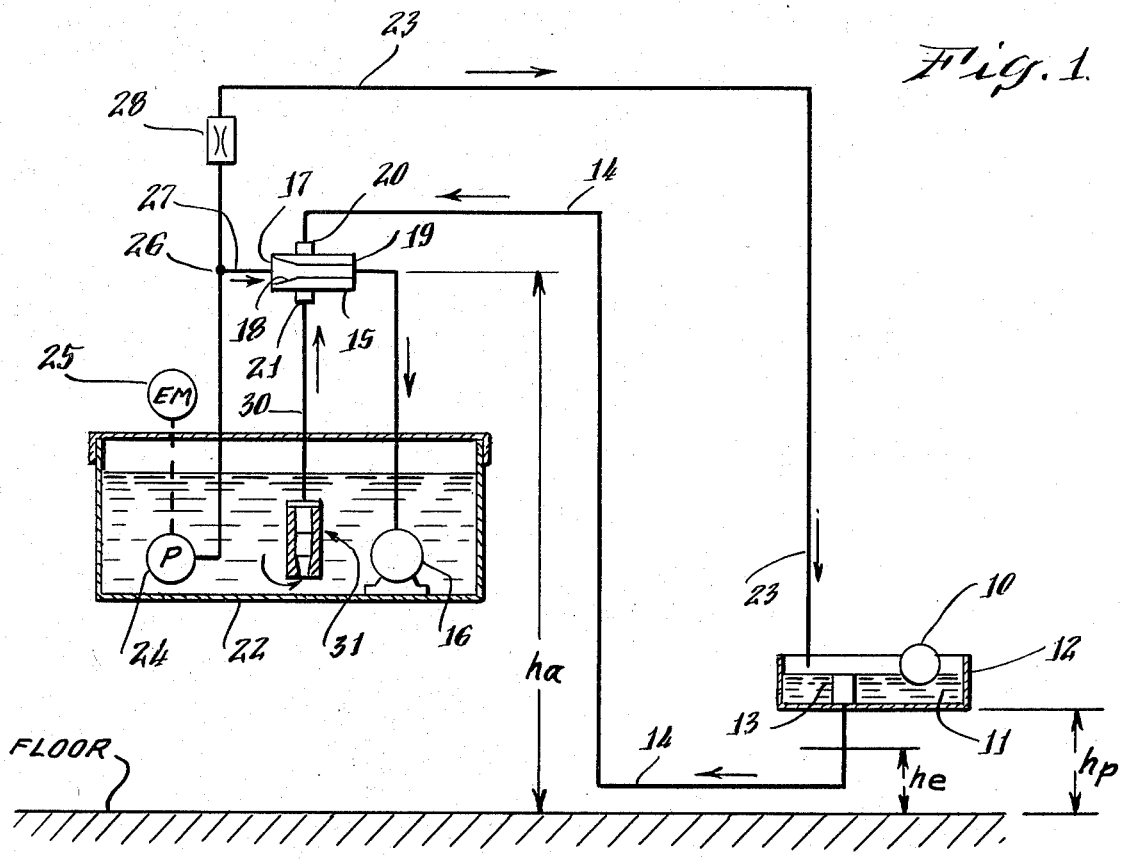
FIG. 1 is a schematic view of a circulating system wherein the height of the pan is lower than the height of the aspirator.

Referring to FIG. 1, a liquid circulating system for use in a printing press is shown schematically. Roller 10 is partially immersed in liquid 11 which is contained in fountain pan 12. Fountain pan 12 includes a standpipe drain 13 which extends a predetermined distance upwardly from the floor of pan 12. The height of the standpipe maintains a predetermined liquid level within the pan. The liquid in the pan should be kept at a relatively constant temperature, and, liquid should flow in and out of the pan 12 at a relatively constant flow rate in order to prevent growth of algae and allow for circulation of the liquid to a filter 16. Standpipe 13 drains to a liquid return conduit 14 which extends downwardly to floor level directly beneath the standpipe 13 and which is eventually directed upwardly to aspirator 15. Return conduit 14 directs the liquid into cannister filter 16 which requires pressure to force the fluid through it. Aspirator 15 includes a motive flow passageway 17 having an inlet 18 and an outlet 19. Aspirator 15 further includes a first inlet suction port 20. By pumping liquid through motive flow passage 17, a negative or suction pressure is induced in the portion of the return conduit between the pan 12 and the aspirator 15. By "negative" or "suction" pressure it is meant a pressure below atmospheric pressure.

Supply conduit 23 extends between the reservoir 22 and pan 12 and provides for a relatively constant flow of liquid into pan 12. Liquid is forced through supply conduit 23 by a pump 24 which is driven by an electrical motor 25. Supply conduit 23 includes a junction 26 therein, junction 26 being connected by an intermediate conduit 27 to inlet 18 of aspirator 15. Thus, pump 24 pumps liquid for two purposes: liquid to be supplied to the pan 12 and liquid to be circulated through aspirator 15 to provide the motive fluid for drawing liquid through return conduit 14. Flow arrows indicate the direction of flow in the various conduits shown in the drawing. Variable flow control valve 28 allows for control of the flow rate of liquid being delivered to pan 12.

The above-described subject matter is a description of a conventional circulating system. It should be understood that in this system, the negative pressure in return conduit 14 is sufficient to not only draw liquid through return conduit 14 but also suction air through standpipe 13 and eventually through return conduit 14 and into reservoir 22. It should be appreciated that suctioning of air into aspirator 15 and the mixing of the air with the liquid being forced through motive passageway 17 results in "foaming" within reservoir 22. In the conventional system, a portion of the foam was circulated to pan 12, and undesirably interfered with the printing process. The disadvantageous foaming has been eliminated by the anti-foaming device of the present invention.

In order to reduce the amount of foam aspirator 15 is provided with an additional inlet port 21 which is connected via conduit 30 to the liquid in reservoir 22. In circulating systems such as that shown in FIG. 1 wherein the height of the pan, $h_p$, is less than the height of the aspirator, $h_a$, a negative pressure is required in return conduit 14 to suction liquid upwardly from the pan 12 to the aspirator 15. However, to avoid "foaming", it is important that the suction or negative pressure within return conduit 14 be kept below a value at which air will be drawn into the system. To control the pressure within return conduit 14, a poppet valve 31 is inserted in conduit 30. Poppet valve 31 allows flow of liquid therethrough only when a predetermined positive pressure differential exists between the inlet and outlet of valve 31. As the negative pressure in return conduit approaches a value at which air would be suctioned into the system, the poppet valve 31 allows the liquid to flow to the aspirator and the suction pressure in the return conduit 14 is maintained below the value at which air would be suctioned into the system.

Figure 2:
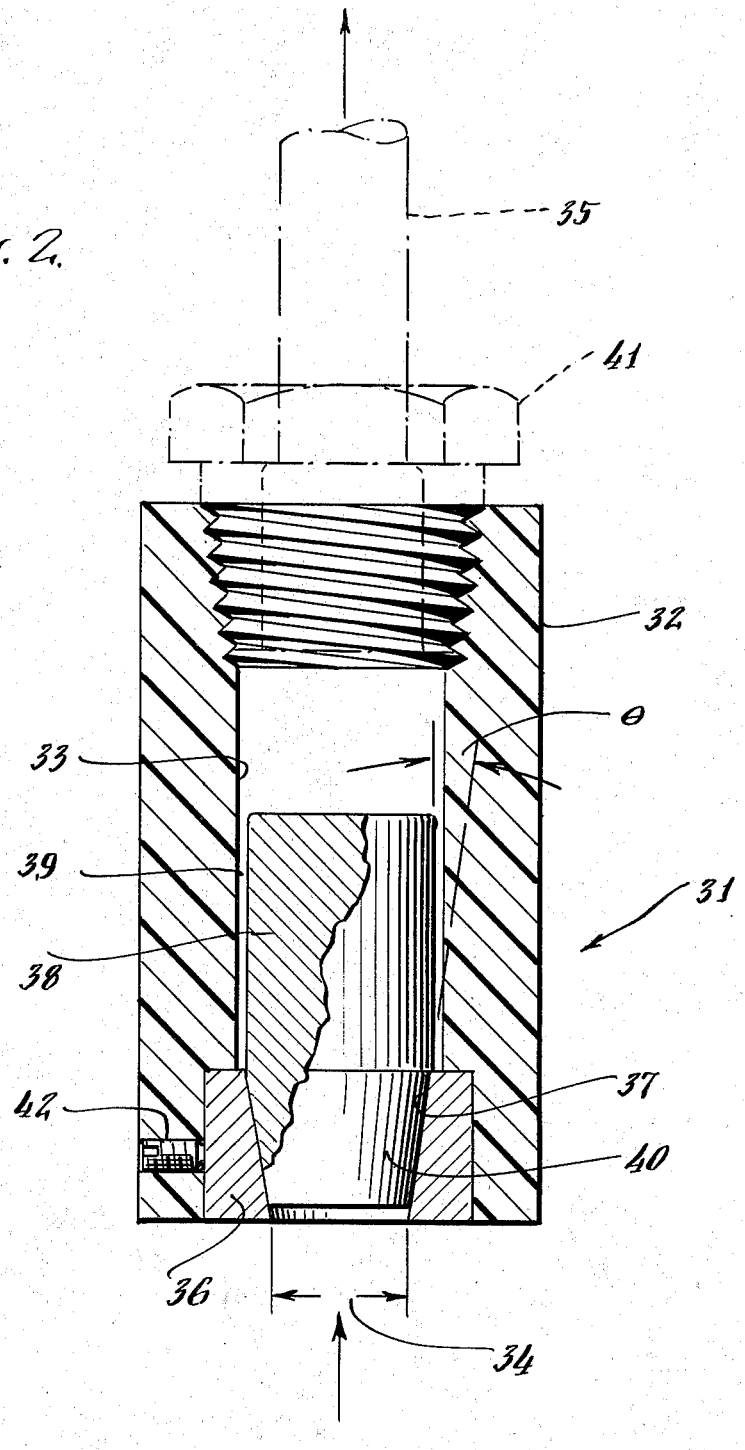
FIG. 2 is a sectional view of the poppet valve shown in FIG. 1.

Referring to FIG. 2, the details of the poppet valve 31 are shown. Poppet valve 31 includes a housing 32 having a cylindrical passageway 33 therethrough. Passageway 33 includes an inlet 34 and an outlet 35. The valve housing 32 is preferably made from a plastic material, for example, such as polyvinylchloride. Positioned within cylindrical passage 33 is a valve seat 36 which has a generally annular shape and which includes an interior frustoconical wall 37 which defines a fluid flow passage. Frustoconical wall 37 has a taper angle, $\theta$, which is preferably between about 8 and about 16 degrees, most preferably about 10 degrees. Poppet valve plug 38 has a cylindrical shape having a diameter slightly less than the interior diameter of passage 33 to define an annular flow passage 39. End portion 40 of valve plug 38 includes a linear tapered outer wall which is preferably frustoconical in shape and which has the same taper angle as does the frustoconical interior wall 37 of valve seat 36. The upper region of valve body 32 includes a fitting 41 which provides for attachment of the valve to flow conduit 30 as shown in FIG. 1. Preferably, the valve seat 36 and the poppet valve plug 38 are made of stainless steel. The weight of the poppet valve plug 38 may vary from system to system, and, as a general rule, will depend upon the difference in height between aspirator 15 and pan 12. In the case where the aspirator is located 36 inches from the floor and the pan is located 12 inches from the floor, the weight of the poppet valve plug 38 should be between about 320 and 420 grams. In the case where the aspirator 15 is located about 28½ inches above the floor and the pan is located about 12 inches from the floor, the weight of the poppet valve plug 38 should be between about 220 grams and 290 grams. The weight of the poppet valve plug 38 can be varied by using plugs of different lengths. The valve seat 36 is secured within passage 33 by at least one pin 42.

Poppet valve plug 38 moves axially within passage 33 in response to a positive pressure differential between inlet 34 and outlet 35. As used in the circulating system shown in FIG. 1, poppet valve plug 38 remains seated against tapered wall 37 until a predetermined suction pressure is induced in conduit 30 by aspirator 15. By adjusting the sizing and the weight of poppet valve plug 38, the predetermined suction pressure at which the valve 31 will allow flow of fluid therethrough may be determined. Thus, referring to FIG. 1, before the negative pressure within conduit 14 reaches a point at which air will be drawn or suctioned through conduit 14, poppet valve plug 38 unseats and moves axially upwardly to allow flow through passage 30. In a preferred embodiment of the invention, the weight of the poppet valve plug 38 is determined so that there is a relatively constant height of water in the portion of the return conduit 14 immediately below standpipe 13. The height of liquid is indicated as $h_e$. Thus, the liquid in pan 12 drains into return conduit 14 which is maintained at a height $h_e$ and, thus, little or no air is drawn through return conduit 14. Although $h_e$ will vary depending on the particular circumstance and dimensions in the circulating system, for a pan height of approximately one foot, it is preferred that the liquid height be kept about 6 inches from the floor.

Figure 3:
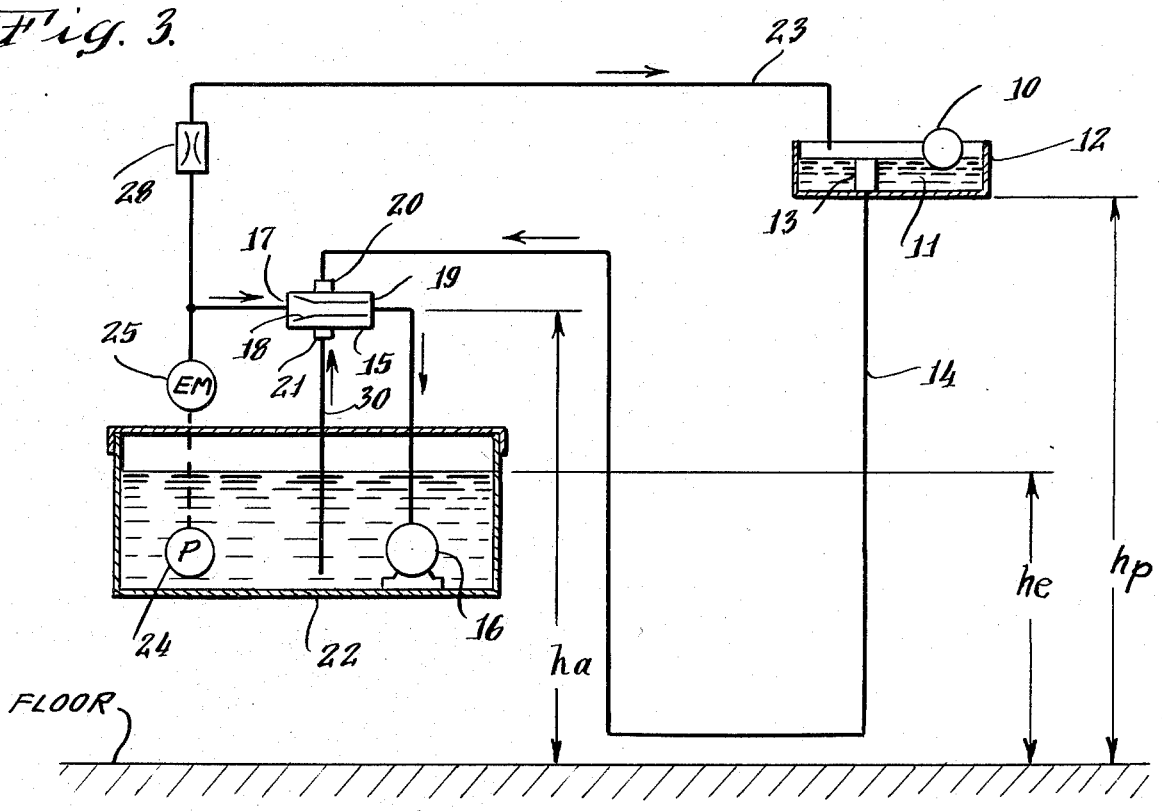
FIG. 3 is a schematic view of the circulating system wherein the height of the pan is at least one foot higher than the height of the aspirator.

FIG. 3 shows an embodiment of the circulating system wherein the height of the pan, $h_p$, is greater than the height of the aspirator, $h_a$. Since many of the elements in FIG. 3 correspond to elements shown in FIG. 1, they are numbered identically, and these elements will not be described further. In the type of circulating system wherein the pan height is at least one foot greater than the height of the aspirator, it is not necessary to include a poppet valve in conduit 30. Conduit 30, in the embodiment shown in FIG. 3, is simply an unobstructed conduit. By allowing inlet 21 of aspirator 15 to draw liquid from reservoir 22, the liquid level $h_e$ in return conduit 14 remains approximately the same as the level of the liquid in reservoir 22. Return conduit 14 is directed downwardly from aspirator 15 to floor level and then upwardly to standpipe 13. Thus, liquid in pan 12 can drain via standpipe 13 and the suctioning of air through the return conduit is eliminated. The inner diameter of conduit 30 should be slightly less than the inner diameter of return conduit 14. An exemplary conduit size would be ¾ inch for return conduit 14 and ⅝ inch for conduit 30.

If the difference in height between the pan and the aspirator is less than one foot, insufficient gravity drainage from pan 12 may occur, and it may be necessary to install a poppet valve in conduit 30 to provide for increased negative pressure in return conduit 14.

Figure 4:
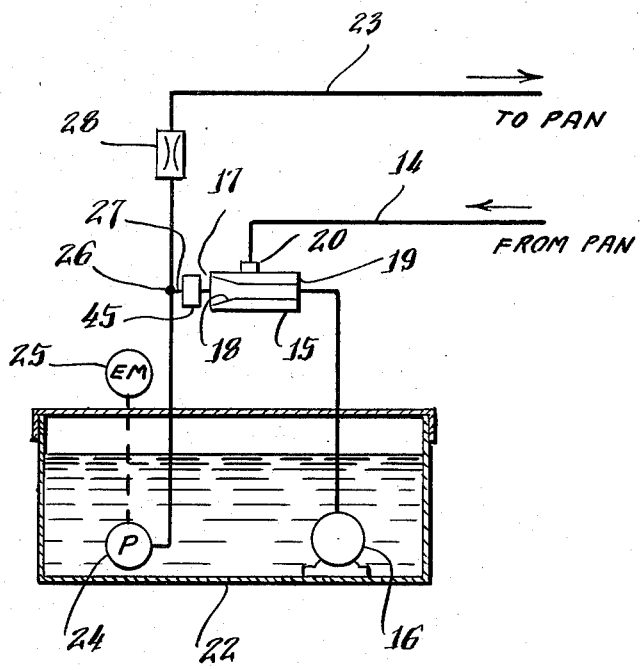
FIG. 4 is a schematic view of a portion of a circulating system wherein suction pressure in the return conduit is controlled by a throttle valve positioned upstream of the aspirator.

Referring to FIG. 4, a portion of a circulating system is shown. The anti-foaming system shown in FIG. 4 may be used in both types of circulating systems, that is, systems wherein the fountain pan is above the aspirator or the aspirator is above the fountain pan. Valve 45 is positioned in conduit 27 and controls the volume flow rate of liquid being pumped through aspirator 15, which in turn controls the suction pressure in return conduit 14. Valve 45 is preferably adjustable to provide for adjustment of the suction pressure in the return conduit 14.

Figure 5:
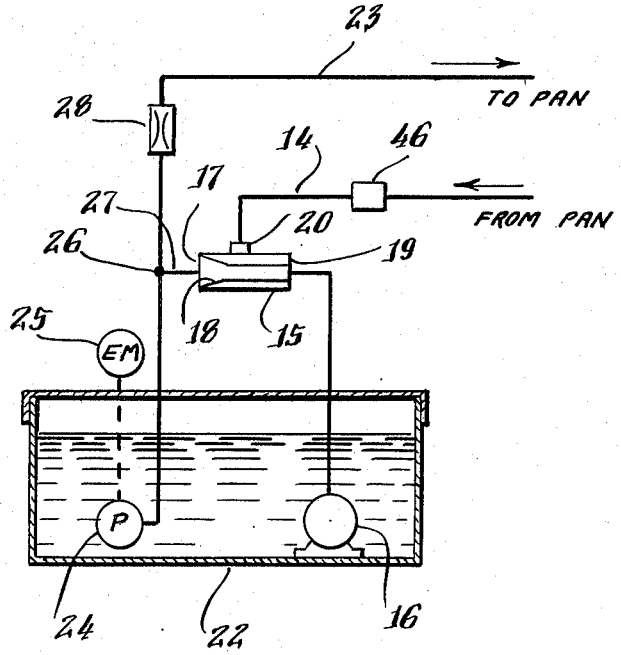
FIG. 5 is a schematic view of a portion of a circulating system wherein the suction pressure in the return conduit is controlled by a vacuum pressure regulator.

Referring to FIG. 5, a portion of a circulating system is shown. The anti-foaming system shown in FIG. 5 may be used in both types of circulating systems, that is, systems wherein the fountain pan is above the aspirator or the aspirator is above the fountain pan. Vacuum pressure regulator 46 is positioned in return conduit 14 between the aspirator and the fountain pan and controls the suction pressure in the return conduit 14. Preferably, pressure regulator 46 is adjustable.

It should be understood that the anti-foaming devices described previously may be fitted on existing printing presses or on new printing presses. The device may be used in ink circulating systems or water solution circulation systems in printing presses. The type of ink circulating system where this device is most applicable is that used in the flexograph printing system.

It should be understood that although a specific embodiment of the invention has been described herein in detail, such description is for purposes of illustration only and modifications may be made thereto by those skilled in the art within the scope of the invention.

What is claimed is:

1. In a printing press liquid circulation system of the type wherein liquid is circulated via a return conduit from a fountain pan through a filter to a reservoir, the fountain pan including a standpipe for draining liquid and for maintaining a substantially constant liquid level in the fountain pan, the system including aspirating means connected between the fountain pan and the filter, said aspirating means having an inlet, an outlet and a suction port, said return conduit being connected to said suction port, pump means for supplying motive liquid to the inlet of the aspirating means, said aspirating means inducing a suction pressure in the return conduit between the aspirating means and the fountain pan to draw liquid from the return conduit and to mix the liquid from the fountain pan with the motive liquid, the pump means forcing the mixture through said filter into said reservoir, the improvement comprising:

conduit means connected between said aspirating means and said reservoir, said aspirating means inducing a suction pressure in said conduit means to draw liquid from said reservoir to said aspirating means to maintain a liquid level in said return conduit and to reduce the suction pressure in the return conduit to a value sufficient to suction only liquid through said return conduit.

2. In a system of the type described in claim 1 and wherein the height of the pan is greater than the height of the aspirator and wherein a portion of the return conduit extends below the level of the liquid in the return conduit, the improvement comprising: said conduit means being unobstructed.

3. In a system of the type described in claim 2 wherein said conduit means has an inner diameter which is less than the inner diameter of the return conduit.

4. In a system of the type described in claim 1 and wherein the height of the pan is lower than the height of the aspirator, the improvement further comprising:

valve means positioned in said conduit means between said reservoir and said aspirator, said valve means including an inlet port and an outlet port, said valve means being responsive to a pressure differential between said inlet port and said outlet port to allow flow of liquid when a predetermined pressure differential is reached.

5. In a system of the type described in claim 4 wherein said valve includes a means valve housing defining a cylindrical liquid flow path defining said outlet and said inlet, a valve seat having an interior frustoconical wall defining a liquid flow aperture, said valve seat being positioned in the liquid flow path of said valve housing, a poppet valve plug moveably positioned within said liquid flow path and having a cylindrical shape, one end portion of said poppet valve plug having a linear tapering outer wall which seats with the interior frustoconical wall of said valve seat to close the valve, said poppet valve plug being movable in an axial direction in response to a pressure differential between the inlet and the outlet to provide an annular liquid flow passage.

6. A printing press circulation system for circulating dampening liquid and for reducing foaming in the dampening liquid, the system comprising:

a pan including a standpipe for draining said liquid and for maintaining a substantially constant liquid level in the pan;

a reservoir for holding said liquid;

an aspirator having an inlet, an outlet, a first suction port and a second suction port;

a return conduit extending from said standpipe of said pan to said first suction port for draining liquid from the pan, a portion of said return conduit extending downwardly from said standpipe, a conduit extending between said outlet of said aspirator and said reservoir, and a conduit extending between the second suction port and the reservoir;

means for pumping liquid from said reservoir to the inlet of said aspirator to induce suction in said return conduit and in said conduit extending between the second suction port and the reservoir to maintain a liquid level in said portion of said return conduit and to reduce the suction in the return conduit to a value sufficient to suction only liquid through said return conduit.

7. A circulation system according to claim 6 wherein said pan has a height lower than the height of the aspirator and further including valve means positioned in said conduit extending between said second suction port of said aspirator and said reservoir, said valve means including an inlet port and an outlet port and being responsive to a pressure differential between said inlet port and said outlet port to allow flow of liquid when a predetermined pressure differential is reached.

8. A circulating system according to claim 7 wherein said valve means includes a valve housing defining a cylindrical liquid flow path defining said outlet and said inlet, a valve seat having an interior frustoconical wall defining a liquid flow aperture, said valve seat being positioned in the liquid flow path of said valve housing, a poppet valve plug moveably positioned within said liquid flow path and having a cylindrical shape, one end portion of said poppet valve plug having a linear tapering outer wall which seats with the interior frustoconical wall of said valve seat to close the valve, said poppet valve plug being movable in an axial direction in response to a pressure differential between the inlet and the outlet to provide an annular liquid flow passage.

* * * * *